United States Patent [19]

Dirla

[11] Patent Number: 4,867,585

[45] Date of Patent: Sep. 19, 1989

[54] RIBBON CASSETTE WITH SWINGABLE RIBBON-GUIDE ARMS

[75] Inventor: Manfred Dirla, Overath, Fed. Rep. of Germany

[73] Assignee: Regentrop & Bernard GmbH, Wuppertal, Fed. Rep. of Germany

[21] Appl. No.: 140,463

[22] Filed: Jan. 4, 1988

[30] Foreign Application Priority Data

Jan. 2, 1987 [DE] Fed. Rep. of Germany ... 8700067[U]

[51] Int. Cl.[4] ..... B41J 32/00

[52] U.S. Cl. ..... 400/208; 400/248

[58] Field of Search ..... 400/194, 195, 196, 196.1, 400/207, 208, 208.1, 216.1, 240, 240.4, 248, 694

[56] References Cited

U.S. PATENT DOCUMENTS

| | | | |
|---|---|---|---|
| Re. 31,117 | 1/1983 | Depew | 400/208 |
| 3,643,777 | 2/1972 | Anderson et al. | 400/196.1 X |
| 3,899,065 | 8/1975 | Brignole | 400/208 |
| 4,175,877 | 11/1979 | Randolph | 400/196 |
| 4,728,207 | 3/1988 | Foster | 400/248 |
| 4,729,677 | 3/1988 | Dirla et al. | 400/208 |

FOREIGN PATENT DOCUMENTS

| | | | |
|---|---|---|---|
| 2757993 | 6/1979 | Fed. Rep. of Germany | 400/208 |
| 0056895 | 5/1981 | Japan | 400/208 |

*Primary Examiner*—Ernest T. Wright, Jr.
*Attorney, Agent, or Firm*—Goodman & Teitelbaum

[57] ABSTRACT

A ribbon cassette for writing and/or printing machines, the ribbon cassette including a casing with an upper part, a lower part as well as two ribbon-guide arms extending substantially parallel to one another away from the casing, an ink ribbon, a feed spool, a take-up spool as well as a drive member controllable by the machine for the onward transport of the ink ribbon, in which the ribbon has a ribbon section running freely between the two ribbon-guide arms outside the casing, and in which the ribbon-guide arms are borne on the casing in such a way that the ink ribbon, for the selection of one of several writing tracks, is movable against the force of restoring springs perpendicular to the band longitudinal axis in the ribbon plane of the ribbon section. The ribbon-guide arms are tied over film hinges in one piece to the casing. Preferably, each ribbon-guide arm is tied over two film hinges laterally spaced from one another to the casing lower part, and each restoring spring is constructed as a V-shaped or U-shaped band spring.

7 Claims, 2 Drawing Sheets

RIBBON CASSETTE WITH SWINGABLE RIBBON-GUIDE ARMS

The present invention relates to a ribbon cassette for writing and/or printing machines, consisting of a casing with an upper part, a lower part as well as two ribbon-guide arms extending substantially parallel to one another away from the casing, an ink ribbon, a feed spool, a take-up spool as well as drive means controllable by the machine for the onward transport of the ribbon, in which the ribbon has a ribbon section running freely outside the casing between the two ribbon-guide arms, and in which the ribbon-guide arms are swingably borne on the casing in such a way that the ink ribbon is movable perpendicularly to the ribbon longitudinal axis in the band plane of the free ribbon section for the selection of one of several writing tracks by swinging the ribbon guide arms against the force of restoring springs.

In such ribbon cassettes the ink ribbon is conducted over the free ribbon section past a type stroke area of the machine, i.e. between a roller and the types, for example a type wheel. In the process the ribbon guide arms are swung by a machine arrangement against the force of the restoring springs, in order to move the ribbon in its transverse direction, i.e. to shift it parallel to the band plane of the free ribbon section, in order in this way to choose from several writing tracks of the ribbon. This swinging movement occurs in general before each individual stroke, so that the ribbon-guide arms consequently have to move back and forth very rapidly, and very frequently oscillating, the resetting into its starting or rest position being brought about by the restoring spring.

A ribbon cassette of the type described is known, in which the ribbon-guide arms have bearing projections that are guided in corresponding bearing receptacles of a casing wall substantially perpendicular to the cassette plane. This known cassette consists, consequently of many individual parts, whereby its assembling is extremely expensive as well s mainly manual, especially since the ribbon-guide arms are constructed not identical, but mirror symmetrical. Further, also the formation and arrangement of the restoring springs is disadvantageous, since each restoring string consists of a spring wire that is supported on the inside of the perpendicular casing wall presenting the bearing receptacles, runs over a section parallel to the perpendicular casing wall and after a deflection through about 90° through a casing opening parallel to the ribbon-guide arm and engages with its free end portion on a counterbearing of the ribbon-guide arm. The spring force of the restoring spring results, therefore, on the one hand from a bending of the section parallel to the ribbon-guide arm as well as from a torsion of the section running parallel to the casing wall inside the casing. This formation and arrangement of the restoring spring also contributes to an expensive and consequently costly assembling of the known ribbon cassette. An automatic assembling is possible, if at all, only with expensive means.

Underlying the present invention, therefore, is the problem of giving a ribbon cassette a resetting possibility of the ribbon-guide arms which have a small number of simply constructed individual parts and thereby can be assembled in a simple manner, for example also automatically.

According to the invention this is achieved by the means that the ribbon-guide arms are connected over film hinges in one piece to the casing. Through this advantageous construction, three individual parts, i.e. the upper or lower part of the casing and the two ribbon-guide arms, are combined into a one-piece part, whereby an assembling of the ribbon-guide arms becomes entirely unnecessary, since these are connected to the upper or lower part immediately after the production of the upper or lower part of the casing, so that the ribbon-guide arms are swingably movable relative to the upper or lower part. The film hinges are constructed as flute-type portions having the material thickness thereof reduced with respect to the thickness of connecting straps arranged between the casing and the ribbon-guide arms.

Film hinges as such are, to be sure, already known and are used for numerous applications, such as, for example, synthetic material packings, swivel bearing of container caps etc. The use of film hinges for the present case of application for the swinging bearing of ribbon-guide arms of a ribbon cassette, however, is by no means obvious, since—as already stated above—the ribbon-guide arms have to execute frequent and rapid oscillating movements, and, indeed, the ribbon-guide arms in a usual writing operation are moved back and forth within a short time approximately 500,000 times. This means an extremely high load, for which reasons film hinges for this case of application have not been used hitherto, especially since these must have, on the one hand, a high movability and flexibility, but, on the other hand, must assure a high stability of the ribbon-guide arms, so that the guidance function of the ribbon guide arms remains assured.

For this reason the casing, i.e. at least the lower part or the upper part of the casing, of the ribbon cassette of the invention consists advantageously of polypropylene, whereas known cassettes ordinarily consist of an ABS plastic. Polypropylene is a tough, flexible, elastic thermoplastic material. Also the use of polypropylene for ribbon cassette casings, however, was by no means an obvious idea, since this material makes necessary a higher precision in the manufacture as well as greater wall thicknesses. The shaping of the cassette casing, therefore, is somewhat more expensive than in the case of the casings consisting of ABS material, so that hitherto polypropylene did not offer itself for the production of cassette casings. This disadvantage, however, is outweighed by the advantages of one-piece construction of casing and ribbon-guide arms.

In an advantageous further development of the invention the restoring springs are constructed as V-shaped or U-shaped band springs, which abut in each case with one shank on a casing wall perpendicular to the cassette plane and with the other shank on an end surface of the ribbon-guide arm substantially parallel to the perpendicular casing wall. Through this construction according to the invention, also the restoring springs are simply constructed as well as easy to install, since they merely have to be introduced into the zone lying between the casing and the ribbon-guide arm, which can absolutely occur also automatically.

Further advantageous development features of the invention are contained in the following specification.

With the aid of the drawing in the following the invention is explained in detail. In the drawing.

Figure 1:
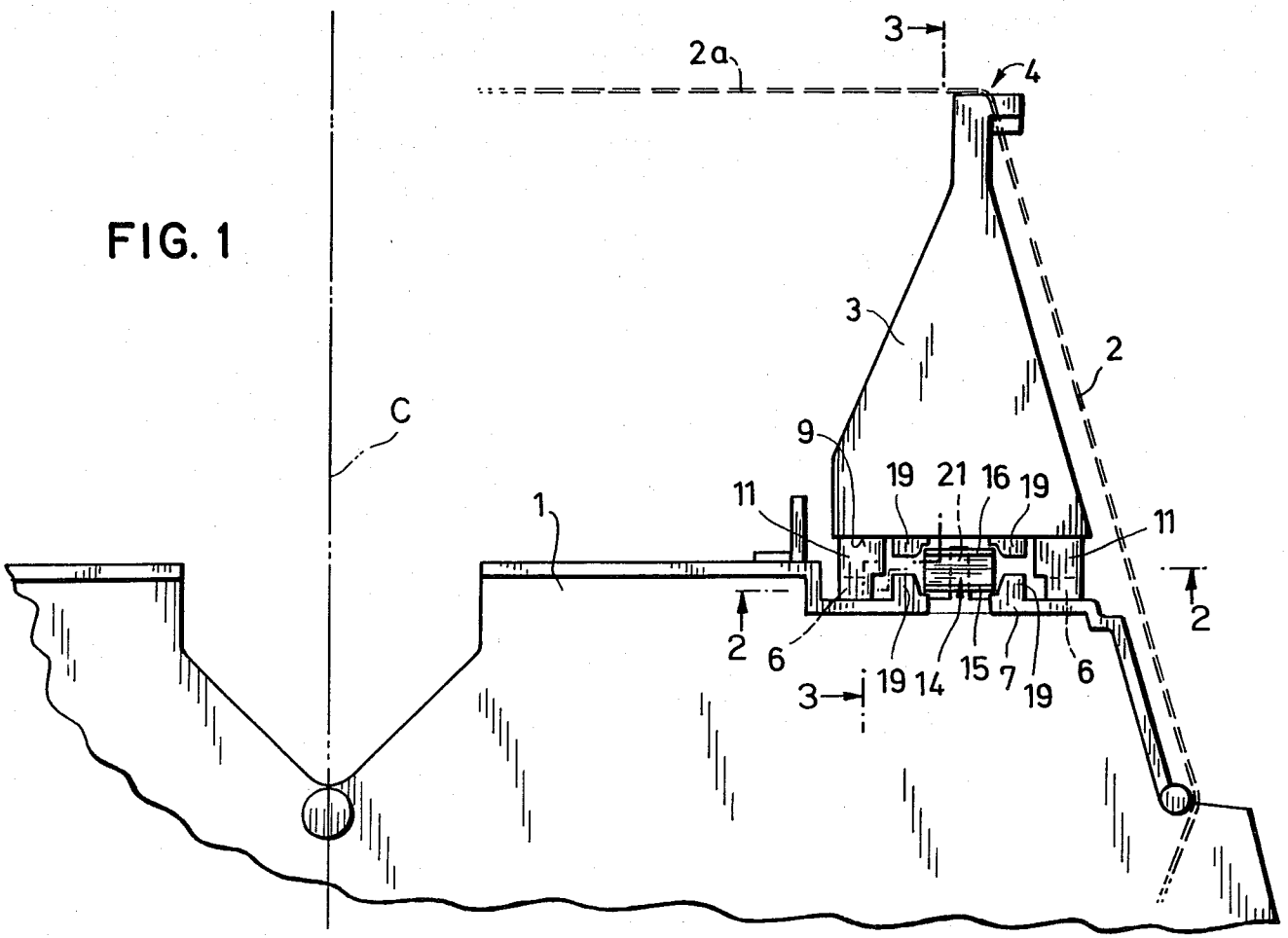
FIG. 1 shows a plan view of a part of the casing lower part of a ribbon cassette according to the invention.
Figure 2:
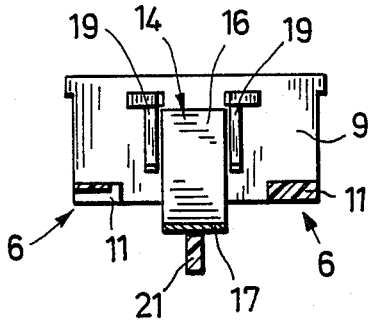
FIG. 2 shows a section along the line 2—2 of FIG. 1.

FIG. 1 shows a part of a casing lower part 1 of a casing of a ribbon cassette according to the invention as well as an ink ribbon 2 (represented in broken lines), the ribbon 2 being known per se in the art, the ribbon 2 being the same type shown in U.S. Pat. No. 4,729,677, to which reference may be made. All the parts not required for the explanation of the present invention have been left out, such as, for example, feed spool, take-up spool, drive means for the onward transport of the ink ribbon 2 and the like, these parts being well known in the art, being shown, for example, in U.S. Pat. No. 3,899,065, to which reference may be made.

The ink ribbon 2 presents a ribbon section 2a running freely outside the casing between two guide arms 3 extending substantially parallel to one another away from the casing, which ribbon section 2*a* is conducted in a manner known per se past a type impact area of a machine i.e. between a roller and type wheel, such as shown in the above mentioned U.S. Pat. No. 3,899,065. In FIG. 1 only one guide arm 3 of the ribbon-guide arms 3 is represented, the unrepresented ribbon-guide arm 3 being constructed in mirror symmetry, about the center line C, to the ribbon-guide arm 3 represented, such construction being obvious to one skilled in the art so that the showing thereof is not thought necessary for an understanding thereof.

Each ribbon-guide arm 3 presents in its free end portion a ribbon guide 4 which deflects the ink ribbon 2 into the plane of the section 2*a* and guides it in a direction perpendicular to the ribbon longitudinal axis, shown in the above mentioned U.S. Pat. No. 4,729,677.

The ribbon-guide arms 3 are swingably borne on the casing, i.e. in the example represented on the lower part 1, in such a way that the ink ribbon 2, for the selection of one of several writing tracks of the ribbon described in the above mentioned U.S. Pat. No. 4,729,677, is movable by swinging of the ribbon-guide arms 3 in the ribbon plane of the free ribbon section 2*a* perpendicularly to the ribbon longitudinal axis. It lies likewise within the scope of the invention to support the ribbon-guide arms 3 on the upper part (not represented in order to make an overview possible) of the casing.

For the swinging bearing of the ribbon-guide arms 3, these are tied according to the invention over so-called film hinges 6 in one piece to the casing, i.e. preferably to the lower part 1. Preferably each ribbon-guide arm 3 is tied to the lower part 1 of the casing over two film hinges 6 laterally spaced from one another.

According to the invention in each case between a casing wall 7 substantially perpendicular to the cassette plane and an end surface 9 substantially parallel to this plane of each ribbon-guide arm 3 there are arranged two connecting straps 11. There the film hinges 6 are expediently formed by flute-type portions having reduced strap thickness, as is to be perceived in particular in FIG. 3.

Figure 3:
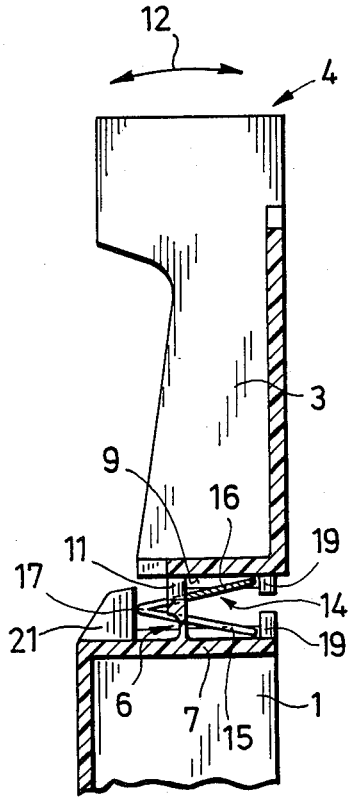
FIG. 3 shows a section along the line 3—3 of FIG. 1.

By reason of the film hinges 6 the ribbon-guide arms 3 are swingable in the direction of the double arrow 12 in FIG. 3. There the ribbon-guide arms 3 are held in each case by a restoring spring 14 in a rest or starting position. The swinging of the ribbon-guide arms 3, accordingly, occurs against the force of the restoring springs 14. It is noted, as stated above, that the ribbon-guide arms 3 are swung by an arrangement on the machine, such arrangement not being part of the present invention and therefore is not shown.

According to the invention each restoring spring 14 is constructed as a V-shaped or U-shaped band spring with two shanks 15, 16 and a connecting portion 17. There in each case the one shank 15 abuts on the perpendicular casing wall 7 and the other shank 16 on the end surface 9 of the ribbon-guide arm 3. By reason of this advantageous construction the restoring springs 14 are very simple to install.

Advantageously both on the perpendicular casing wall 7 and also on the end surface 9 of each ribbon-guide arm 3 there are arranged guide projections 19 for especially lateral fixing of the restoring springs 14. Further, the vertical casing wall 7 presents, according to the invention, in each case a support projection 21 extending about parallel to each ribbonguide arm 3 for the support of the connection portion 17 of the restoring spring 14.

According to the invention the lower part 1 and/or the upper part (not represented as stated above) of the cassette casing, the ribbon-guide arms 3 as well as the connecting straps 11 consist of polypropylene. This material, by reason of its flexibility, elasticity as well as its toughness assures a good movability and also a good stability of the ribbon-guide arms 3. In this connection it is advantageous if the connecting straps 11 have a length measured perpendicularly to the surface of the casing wall 7 of about 3 mm as well as a width of about 4 mm. The material thickness of the straps 11 in the reduced thickness portions of the film hinges 6, i.e. the flute-type, thinned portions, amounts expediently to about 4/10 mm.

This construction according to the invention assures, on the one hand, a sufficient movability of the ribbon-guide arms 3, as well as, on the other hand, a sufficient stability.

The ribbon cassette of the invention is easy to install, since it consists of few individual components. Especially advantageous is the fact that a separate assembling of the ribbon-guide arms 3 can be omitted altogether, since these, immediately after the manufacture of the casing, are already swingably joined with this. The advantageous formation of the restoring springs 14 likewise makes possible a simple assembling, which can also be automated.

The present invention is by no means restricted to the example of execution represented in the drawing, but comprises all features of equivalent nature functioning in the sense of the invention. In particular, it is likewise thinkable to provide instead of film hinges 6 divided in two, in each case a continuous one-part film hinge. This, in contrast to the example represented, can likewise be tied to the upper part of the casing.

What is claimed is:

1. In a ribbon cassette for typewriters and/or printing machines, the ribbon cassette having a casing containing a ribbon, two guide arms extending outwardly from the casing, the ribbon having a ribbon section running freely outside the casing between free ends of the two guide arms, the ribbon section having a longitudinal axis lying in a plane of the ribbon section, the ribbon section plane extending between the two guide arms, the guide arms being swingably mounted to the casing so that the ribbon is movable in the ribbon section plane perpendicular to the longitudinal axis of the ribbon section, an improvement for each guide arm comprising:

said guide arm (3) being connected to said casing (1) by two connecting straps (11) in a one piece construction;

said connecting straps (11) being laterally spaced from each other, and each of said connecting straps (11) being connected between a casing wall (7) and an end surface (9) of said guide arm (3) to provide a space between said casing wall (7) and said end surface (9);

said casing wall (7) being substantially perpendicular to a plane of the cassette, and said end surface (9) being substantially parallel to said casing wall (7);

said connecting straps (11) including flute-type portions having a reduced strap thickness to provide film hinges (6) for swinging said guide arm (3) between a rest position and a swung position;

a restoring spring (14) having first and second legs (15, 16) and a connecting portion (17) to define a V-shaped or U-shaped band spring; and said restoring spring (14) being securely disposed in said space between said casing wall (7) and said end surface (9) with said first leg (15) abutting against said casing wall (7) and said second leg (16) abutting against said end surface (9) so that said restoring spring (14) restores said guide arm (3) to said rest position from said swung position, whereby the swinging of said guide arm (3) towards said swung position acts against a force of said restoring spring (14).

2. A ribbon cassette according to claim 1, wherein said casing (1), said guide arm (3) and said connecting straps (11) consist of polypropylene.

3. A ribbon cassette according to claim 1, including guide means for securing said restoring spring (14) between said casing wall (7) and said end surface (9), said guide means including guide projections (19) provided on at lest one of said casing wall (7) and said end surface (9).

4. A ribbon cassette according to claim 3, wherein said guide projections (19) are provided on both said casing wall (7) and said end surface (9).

5. A ribbon cassette according to claim 4, wherein said guide projections (19) are disposed on opposite sides of said first and second legs (15,16) of said restoring spring (14).

6. A ribbon cassette according to claim 3, wherein a support projection (21) is provided on said casing wall (7), said support projection (21) extending parallel to said guide arm (3) for supporting said connecting portion (17) of said restoring spring (14).

7. A ribbon cassette according to claim 1, wherein a support projection (21) is provided on said casing wall (7), said support projection (21) extending parallel to said guide arm (3) for supporting said connecting portion (17) of said restoring spring (14).

* * * * *